US012674603B1

(12) United States Patent
Kuster et al.

(10) Patent No.: US 12,674,603 B1
(45) Date of Patent: Jul. 7, 2026

(54) WATER DELIVERY SYSTEM

(71) Applicants: Hans L. Kuster, Barrington, RI (US); Michael Ferruccio, Warwick, RI (US); Ryan Bateman, Coventry, RI (US)

(72) Inventors: Hans L. Kuster, Barrington, RI (US); Michael Ferruccio, Warwick, RI (US); Ryan Bateman, Coventry, RI (US)

(73) Assignee: AquaMotion, Inc., Barrington, RI (US)

( * ) Notice: Subject to any disclaimer, the term of this patent is extended or adjusted under 35 U.S.C. 154(b) by 0 days.

(21) Appl. No.: 18/978,588

(22) Filed: Dec. 12, 2024

Related U.S. Application Data

(60) Provisional application No. 63/622,814, filed on Jan. 19, 2024.

(51) Int. Cl.
*G08B 1/00* (2006.01)
*F24H 15/486* (2022.01)

(52) U.S. Cl.
CPC ..... *F24H 15/486* (2022.01)

(58) Field of Classification Search
CPC ..... F24H 15/486; F24H 1/122; F24H 15/325; F24H 15/156; F24H 15/335; F24H 15/355; F24D 17/0078; F24D 19/1051; F24D 2220/025; Y10T 137/6497; E03B 7/045
USPC ..... 340/309.16, 309.3, 309.6, 309.9, 286.01
See application file for complete search history.

(56) References Cited

U.S. PATENT DOCUMENTS

| | | | | |
|---|---|---|---|---|
| 8,083,500 | B1 | 12/2011 | Lebkuchner et al. | |
| 8,303,184 | B1 | 11/2012 | Lebkuchner et al. | |
| 8,785,824 | B1 * | 7/2014 | Farr | F24H 9/2007 219/494 |
| 9,328,736 | B2 | 5/2016 | Lebkuchner et al. | |
| 9,863,647 | B1 | 1/2018 | McNamara et al. | |
| D834,145 | S | 11/2018 | McNamara et al. | |
| 10,612,793 | B1 | 4/2020 | Kuster et al. | |
| 11,193,605 | B1 | 12/2021 | Kuster et al. | |
| D949,927 | S | 4/2022 | Kuster et al. | |
| D960,202 | S | 8/2022 | Kuster et al. | |
| D975,748 | S | 1/2023 | Kuster et al. | |
| D975,749 | S | 1/2023 | Kuster et al. | |
| D975,750 | S | 1/2023 | Kuster et al. | |
| 11,713,562 | B1 | 8/2023 | Kuster et al. | |
| 11,767,988 | B1 | 9/2023 | Kuster et al. | |
| 11,853,086 | B1 | 12/2023 | Kuster et al. | |
| 2012/0060772 | A1 * | 3/2012 | Roy | F24H 15/31 122/14.2 |
| 2013/0279891 | A1 * | 10/2013 | Laing | F24D 17/0078 137/563 |
| 2018/0080662 | A1 * | 3/2018 | Memur | F24D 3/02 |
| 2022/0196288 | A1 * | 6/2022 | Nolte | F24H 15/407 |

* cited by examiner

*Primary Examiner* — Anh V La
(74) *Attorney, Agent, or Firm* — Salter & Michaelson

(57) ABSTRACT

A combination of a combi-boiler and a system for providing hot and cold water in a domestic water delivery system. The combi-boiler provides heated water for heating an establishment. The domestic water delivery system includes a water circulator that feeds the combi-boiler; and a control device or guard member connected to the circulator for controlling the operation thereof. The control device controls the respective "on" and "off" times of operation of the circulator fine-tuned to any home or business.

15 Claims, 3 Drawing Sheets

WATER DELIVERY SYSTEM

CROSS-REFERENCE TO RELATED APPLICATION

Priority for this application is hereby claimed under 35 U.S.C. § 119(e) to commonly owned and U.S. Provisional Patent Application No. 63/622,814 which was filed on Jan. 19, 2024 and which is incorporated by reference herein in its entirety.

FIELD OF THE INVENTION

The present invention relates in general to a water delivery system particularly for tankless water heaters. More particularly, the present invention relates to tankless combi-boilers that are designed to produce hot water for domestic water systems and for hydronic heating purposes.

BACKGROUND OF THE INVENTION

Currently, tankless combi-boilers are designed to produce hot water for domestic water systems and for hydronic heating. Priority on most combi-boilers is given to domestic hot water. Adding hot water recirculation to combi-boilers to prevent wasting 12,000 gallons of water per year, and experiencing the added comfort of instant hot water, presents a dilemma for combi-boilers.

The problem is that these systems prioritize domestic hot water heating for too long of a period, thus negating hydronic heating which will create colder temperatures in the home. The present invention solves this problem with the ability of the homeowner to set the pump cycle time for the domestic water recirculation system.

The cycle time is set by means of controlling the pump ON and OFF times. This allows the Combi-Guard System and the recirculation system to work together for greater efficiency and savings. The Combi-Guard System works for all home/heating system sizes.

SUMMARY OF THE INVENTION

A water delivery system in which there is provided control between a boiler and a domestic hot water apparatus that includes a recirculation circulator, the improvement of controlling the "on" and "off" time of the domestic water hot water recirculation circulator by means of a guard member.

The water delivery system wherein the "on" and "off" time of the domestic water hot water recirculation circulator is one of an analog version and a digital version; wherein the guard member includes a display box for mounting components; wherein, for the analog version there is included on a flat surface of the display box a pair of adjacently disposed rotary dials; one of the rotary dials controlling the "on" time of the circulator and the other of the pair of rotary dials controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a timer for measuring time by turning a timer dial clockwise to the current time in a 24-hour period; wherein the "on" indicator light is arranged over the dial that controls "on" time; and wherein the "off" indicator light is arranged over the dial that controls "off" time; and wherein the display box has a top surface and a bottom surface, with an electrical connection provided at the top surface to a power outlet and with the bottom surface for mounting a connection to the circulator.

The water delivery system wherein, for the digital version there is included on a flat surface of the display box a pair of adjacently disposed indicator button; one of the indicator buttons controlling the "on" time of the circulator and the other of the pair of indicator buttons controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a digital timer module for measuring time by turning a timer dial in a 24-hour period; wherein the "on" indicator light is arranged to the side of the indicator button that controls "on" time; and wherein the "off" indicator light is arranged to the side of the indicator button that controls "off" time; wherein the display box has a top surface and a bottom surface, with an electrical connection provided at the top surface to a power outlet and with the bottom surface for mounting a connection to the circulator; including a pair of display screens associated respectively with the pair of indicator lights and disposed respectively between an indicator light and indicator button.

A combination of a combi-boiler apparatus and a system for providing hot and cold water in a domestic water delivery system; said combi-boiler providing heated water for heating an establishment; said domestic water delivery system including a water circulator that feeds the combi-boiler; and a control device connected to the circulator for controlling the operation thereof; said control device including means for controlling the respective "on" and "off" times of operation of the circulator fine-tuned to any home or business.

The combination wherein the "on" and "off" time of the domestic water hot water recirculation circulator is one of an analog version and a digital version; wherein the control device includes a display box for mounting components; wherein, for the analog version there is included on a flat surface of the display box a pair of adjacently disposed rotary dials; one of the rotary dials controlling the "on" time of the circulator and the other of the pair of rotary dials controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a timer for measuring time by turning a timer dial clockwise to the current time in a 24-hour period; wherein the "on" indicator light is arranged over the dial that controls "on" time; and wherein the "off" indicator light is arranged over the dial that controls "off" time; and wherein the display box has a top surface and a bottom surface, with an electrical connection provided at the top surface to a power outlet and with the bottom surface for mounting a connection to the circulator.

The combination wherein the "on" and "off" time of the domestic water hot water recirculation circulator is one of an analog version and a digital version; wherein the control device includes a display box for mounting components; wherein, for the digital version there is included on a flat surface of the display box a pair of adjacently disposed indicator button; one of the indicator buttons controlling the "on" time of the circulator and the other of the pair of indicator buttons controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a digital timer module for measuring time by turning a timer dial in a 24-hour period; wherein the "on" indicator light is arranged to the side of the indicator button that controls "on" time; and wherein the "off" indicator light is arranged to the side of the indicator button that controls "off" time; wherein the display box has a top surface and a bottom surface, with an electrical connection provided at the top surface to a power outlet and with the bottom surface for mounting a connection to the circulator; and including a pair of display screens associated respectively with the pair of indicator lights and disposed respectively between an indicator light and indicator button.

A water delivery system in which there is provided control between a boiler and a domestic hot water apparatus that includes a recirculation circulator, means for controlling the "on" and "off" time of the domestic water hot water recirculation circulator by means of a guard member, an input cold water line that connects to the boiler, a home heating line that is connected from the boiler and for providing hot water for heating purposes, a hot water line from the boiler to the circulator, a hot water line from the circulator to provide domestic how water for the home, the guard member for controlling the "on" and "off" time of the circulator, the guard member connected with an AC outlet for powering the guard member, a control line from the guard member to the circulator for controlling the circulator, The hot water delivery system wherein the "on" and "off" time of the domestic water hot water recirculation circulator is one of an analog version and a digital version; wherein the guard member includes a display box for mounting components; wherein, for the analog version there is included on a flat surface of the display box a pair of adjacently disposed rotary dials; one of the rotary dials controlling the "on" time of the circulator and the other of the pair of rotary dials controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a timer for measuring time by turning a timer dial clockwise to the current time in a 24-hour period; wherein the "on" indicator light is arranged over the dial that controls "on" time; and wherein the "off" indicator light is arranged over the dial that controls "off" time; and wherein the display box has a top surface and a bottom surface, with an electrical connection provided at the top surface to a power outlet and with the bottom surface for mounting a connection to the circulator.

The hot water delivery system wherein the "on" and "off" time of the domestic water hot water recirculation circulator is one of an analog version and a digital version; wherein the guard member includes a display box for mounting components; wherein, for the digital version there is included on a flat surface of the display box a pair of adjacently disposed indicator button; one of the indicator buttons controlling the "on" time of the circulator and the other of the pair of indicator buttons controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a digital timer module for measuring time by turning a timer dial in a 24-hour period; wherein the "on" indicator light is arranged to the side of the indicator button that controls "on" time; and wherein the "off" indicator light is arranged to the side of the indicator button that controls "off" time; wherein the display box has a top surface and a bottom surface, with an electrical connection provided at the top surface to a power outlet and with the bottom surface for mounting a connection to the circulator; and including a pair of display screens associated respectively with the pair of indicator lights and disposed respectively between an indicator light and indicator button.

FEATURES OF THE INVENTION

The following are features of the system of the present invention:

Multiple Controls:

- Allows adjustment of domestic hot water recirculation circulator "Run" Time. This "Run" or "On" time can be set to 30 seconds to 30 minutes.
- Allows adjustment of domestic hot water recirculation circulator "Off" Time. This "Off" time can be set to 5 minutes to 50 minutes.
- The "On" and "Off" repeat their cycle based on when the timer module is set to run. Timer module is based on a 24-hour period.

Consists of 3 Versions:

- Analog: Dials control the "On" and "Off" times based on a 24-hour pin timer module
- Digital: Pushbutton arrows control "On" and "Off" times based on a digital timer module with day settings.
- \NIFI Enabled: All controls are enabled through WIFI utilizing an AquaMotion, Inc. phone App.

Indicator Lights:

- Green: illuminated when the "On" time cycle

BRIEF DESCRIPTION OF DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described heron will become apparent with reference to the following detailed description when taken in conjunction with the accompanying drawings in which.

DETAILED DESCRIPTION OF THE INVENTION

Figure 4:
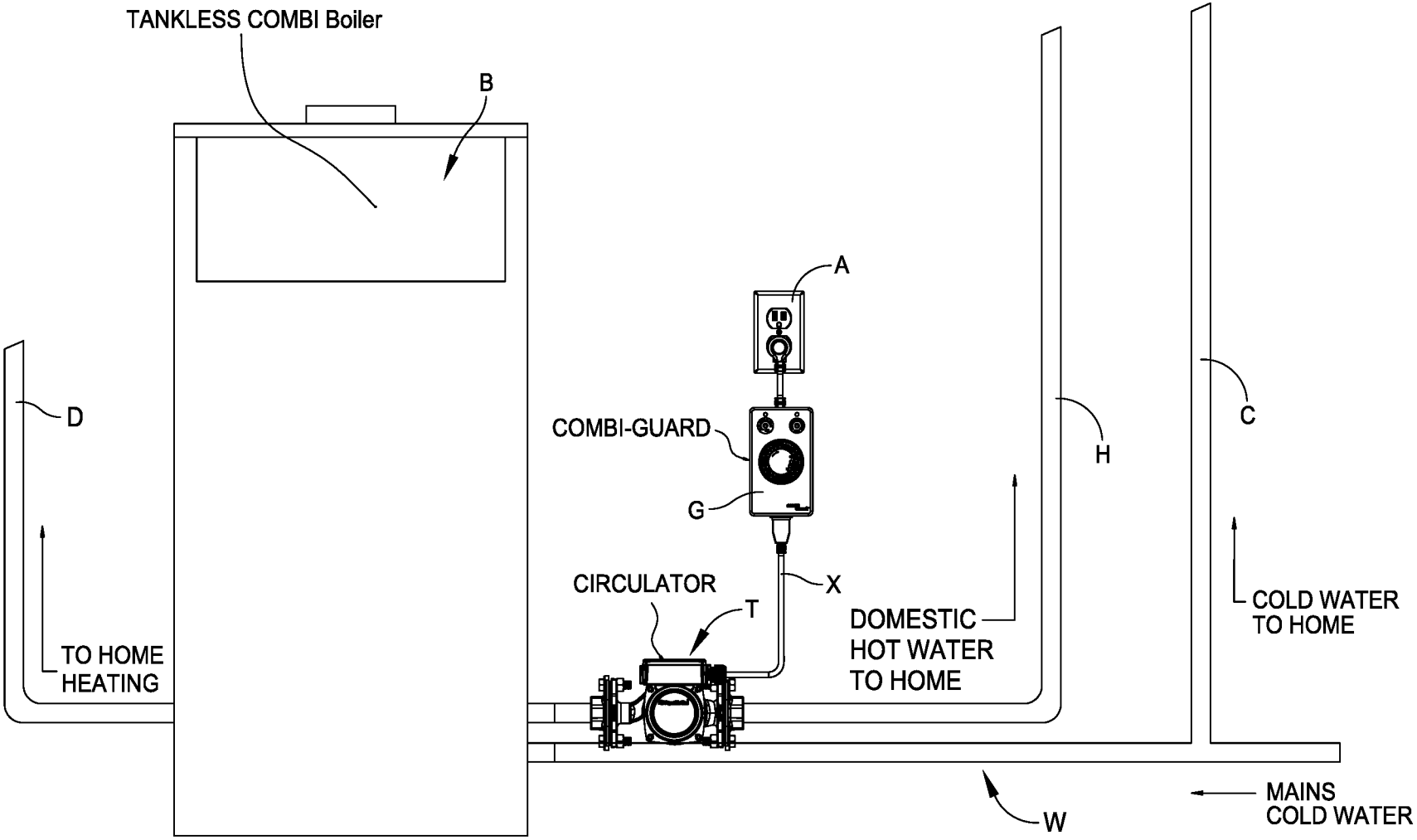
FIG. 4 is a schematic diagram of the combi-boiler apparatus; as integrated with a domestic hot/cold water system.

Reference is first made to the schematic diagram of the combi-boiler apparatus; as integrated with a domestic hot/cold water system. This is illustrated in FIG. 4 where the comb-boiler is illustrated at B, and the domestic water system is illustrated at W. The output of the combi-boiler is illustrated at D connecting to radiators or the like comprising the home heating system. Regarding the domestic water system this is shown in FIG. 4 as including a cold-water main line C and a hot water line H.

The outlet line in FIG. 4 that goes from the Combi-Guard G to the circulator T is the main power cord X for the circulator T. It is a 6-10 foot power cord provided with each circulator which is hard wired inside a plastic junction box mounted on the circulator. The cord X plugs into an AC outlet A. Thus, the combi-guard device G controls the circulator T as to its "on" and "off" cycle.

Figure 5:
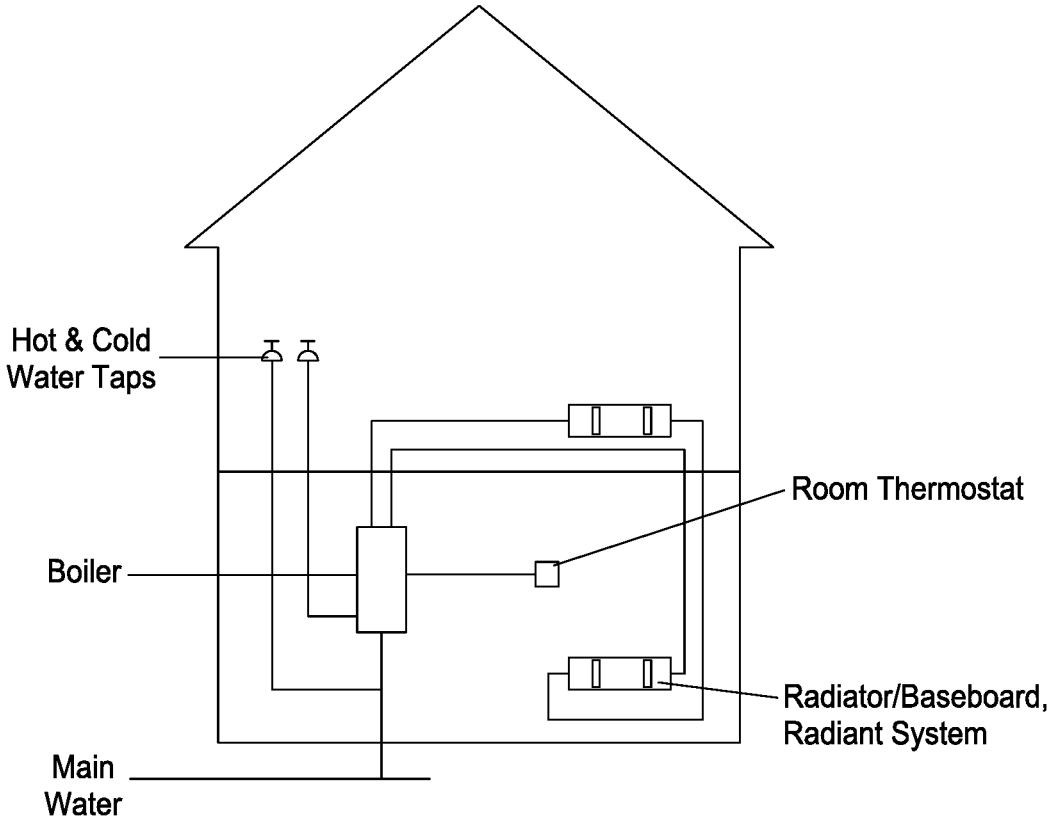
FIG. 5 is a schematic diagram of a combi-boiler system.

Refer to FIG. 5 for a diagram of a typical combi-boiler arrangement.

Figure 3:
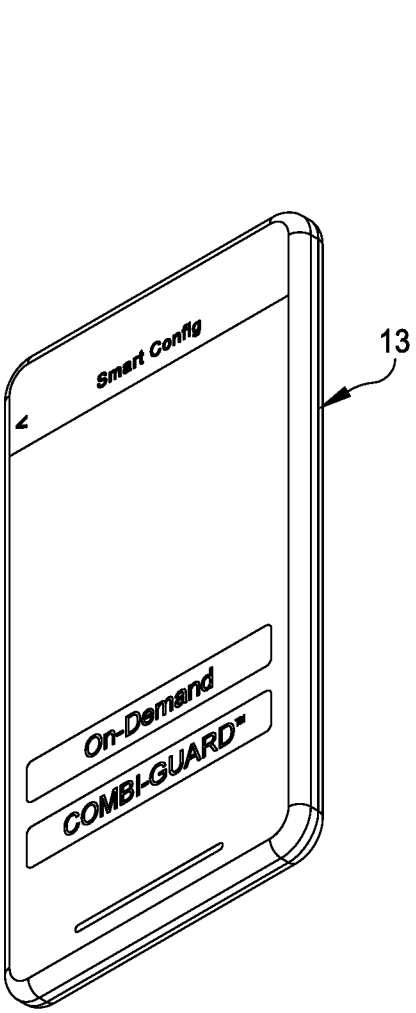
FIG. 3 illustrates the App Controller that uses a handheld device such as a cell phone that is Wifi capable and is compatible with system controls; and with all functions programmed and controlled from this App.
Figure 2:
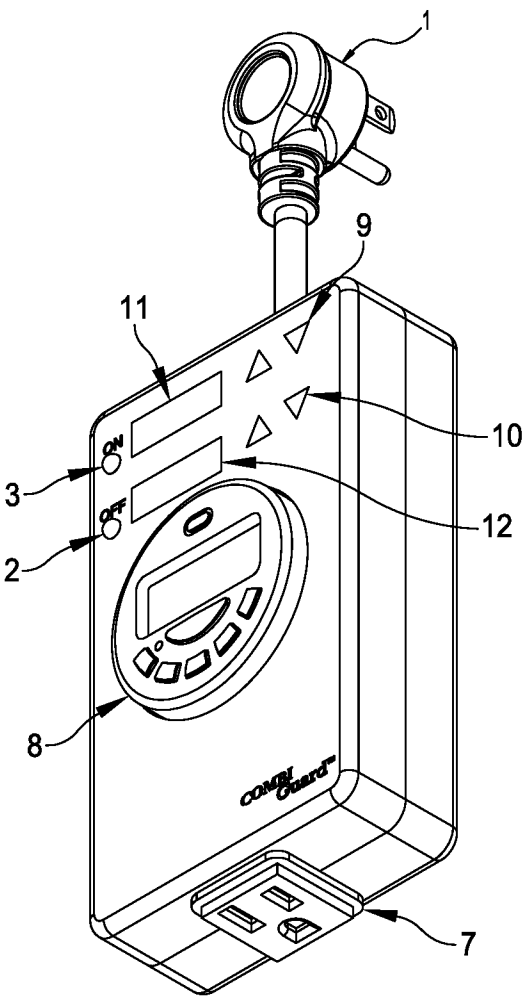
FIG. 2 is a front perspective view of the combi-boiler guard device with digital control.
Figure 1:
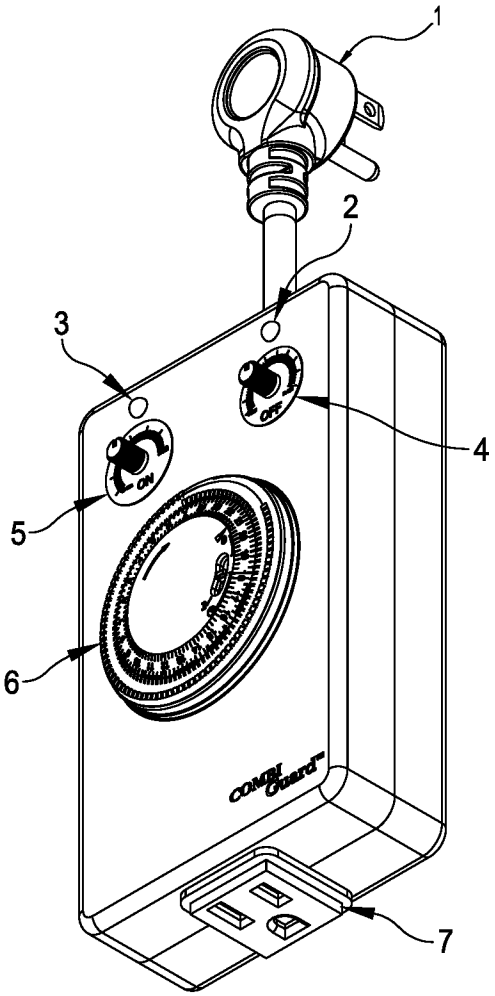
FIG. 1 is a front perspective view of the combi-boiler guard device with analog control.

Reference is now made to FIGS. 1-3 and in particular FIGS. 1 and 2 that show the combi-guard device G as to its external makeup and function. Within the device G there would be a printed circuit board (PCB) with a microcontroller unit (MCU) to process the electrical signals from a 24-hour timer module and the on/off duration dials 4 and 5. In this connection also refer to the list of reference numbers set forth hereinafter; and their corresponding related descriptions. Furthermore, based on these signals the MCU would process an additional electric signal to send power to the device (Circulator T) that is plugged into the lower outlet of the Combi-Guard G. The duration dials, timer module, and power supply would all be soldered directly to the PCB. Other components that will be soldered on the PCB include Light-emitting diodes (LED), resistors, capacitors, fuses, transistors, and a battery. The battery would be for a backup power supply if the main power from the home is lost.

A bypass valve shall also be provided as part of the water delivery system. This can be in the form of an ODR valve such as found in U.S. Pat. Nos. 10,612,793 and 11,853,086, The bypass valve is typically located under the faucet arrangement and limits the water temperature so that it is not too hot and scalding.

The following is an illustration of the reference numbers shown in FIG. 1-3; and corresponding descriptions thereof.

1. Main power plug—allows to be connected to the primary alternating current (AC) power supply in home.

2. Indicator light (green)—illuminating device that is used to signify combi-guard is receiving power to operate another device attached to #7.

3. Indicator light (red)—illuminating device that is used to signify combi-guard is not receiving power to operate another device attached to #7.

4. Rotary dial w/set point scale (on)—a manually adjustable potentiometer that when rotated by hand either clockwise or counterclock wise shall result in a device connected to #7 to operate for a duration indicated on set point scale. Scale: 30 seconds to 30 minutes; 30 second increments. Wherever increments listed movements (or other scales).

5. Rotary dial w/set point scale (off)—a manually adjustable potentiometer that when rotated by hand either clockwise or counterclock wise shall result in a device connected to #7 to not operated for a duration indicated on set point scale. Scale: 5 minutes to 50 minutes; 1 minute increments.

6. Timer module (mechanical)—a device that uses clockwork to measure time. Typically set by turning dial clockwise to current time in a 24-hour period and manually pushing levers at the desire duration to operate a device attached to #7.

7. Output power plug—allows to be connected to the primary alternating current (ac) power supply as required per setting programmed.

8. Timer module (digital)—a programmable device that uses clockwork to measure time. Typically set by programming this device for current time in a 24-hour period as well as the desire duration to operate a device attached to #7.

9. Indicator buttons (on)—a momentary push button connected to a circuit board that is pushed to program desired duration to operate a device attached to #7. Directional arrows indicate the increase or decrease in duration. The set point scale is programed into the circuit board. Scale: 30 seconds to 30 minutes; 30 second increments.

10. Indicator buttons (off)—a momentary push button connected to a circuit board that is pushed to program desired duration to operate a device attached to #7. Directional arrows indicate the increase or decrease in duration. The set point scale is programed into the circuit board. Scale: 5 minutes to 50 minutes; 1 minute increments.

11. Display screen (on)—visual display unit that digitally shows the duration as set per #9.

12. Display screen (off)—visual display unit that digitally shows the duration as set per #10.

13. App controller—using a handheld device that is wifi capable and is compatible with the Aquamotion app. All function shall be programmed and controlled by this app.

The following are the reference numbers and related components used in connection with FIG. 4:

A AC outlet
B tankless combi-boiler
C cold water line
D home heating system
G combi-guard device
T hot water circulator
X line from A to T
W water delivery system The foregoing is a preferred embodiment of the present invention. It is not intended to limit the present invention. Any modifications within the spirit and principles of the present invention, made, equivalent replacement, or improvement should be included within the scope of the present invention.

The above descriptions relate to the preferred embodiments of this invention, and do not restrict this invention. All the modifications, equivalent substitutions and improvements made based on spirit and principle of this invention are included in the protective range of this invention.

The invention claimed is:

1. A water delivery system in which there is provided control between a boiler and a domestic hot water apparatus that includes a recirculation circulator, the improvement of controlling the "on" and "off" time of the domestic water hot water recirculation circulator by means of a guard member wherein the "on" and "off" time of the domestic hot water recirculation circulator is one of an analog version and a digital version wherein the guard member includes a display box for mounting components wherein, for the analog version there is included on a flat surface of the display box a pair of adjacently disposed rotary dials; one of the rotary dials controlling the "on" time of the circulator and the other of the pair of rotary dials controlling the "off" time of the circulator.

2. The water delivery system of claim 1 including on the flat surface of the display box a pair of adjacently disposed indicator lights; one of the indicator lights indicating the "on" time of the circulator and the other of the pair of indicator lights indicating the "off" time of the circulator.

3. The water delivery system of claim 2 including on the flat surface of the display box a timer for measuring time by turning a timer dial clockwise to the current time in a 24-hour period.

4. The water delivery system of claim 3 wherein the "on" indicator light is arranged over the dial that controls "on"

time; and wherein the "off" indicator light is arranged over the dial that controls "off" time.

5. The water delivery system of claim 4 wherein the display box has a top surface and a bottom surface, with an electrical connection provided at the top surface to a power outlet and with the bottom surface for mounting a connection to the circulator.

6. A water delivery system in which there is provided control between a boiler and a domestic hot water apparatus that includes a recirculation circulator, the improvement of controlling the "on" and "off" time of the domestic water hot water recirculation circulator by means of a guard member wherein the "on" and "off" time of the domestic hot water recirculation circulator is one of an analog version and a digital version wherein the guard member includes a display box for mounting components wherein, for the digital version there is included on a flat surface of the display box a pair of adjacently disposed indicator buttons; one of the indicator buttons controlling the "on" time of the circulator and the other of the pair of indicator buttons controlling the "off" time of the circulator.

7. The water delivery system of claim 6 including on the flat surface of the display box a pair of adjacently disposed indicator lights; one of the indicator lights indicating the "on" time of the circulator and the other of the pair of indicator lights indicating the "off" time of the circulator.

8. The water delivery system of claim 7 including on the flat surface of the display box a digital timer module for measuring time by turning a timer dial in a 24-hour period.

9. The water delivery system of claim 8 wherein the "on" indicator light is arranged to the side of the indicator button that controls "on" time; and wherein the "off" indicator light is arranged to the side of the indicator button that controls "off" time.

10. The water delivery system of claim 9 wherein the display box has a top surface and a bottom surface, with an electrical connection provided at the top surface to a power outlet and with the bottom surface for mounting a connection to the circulator.

11. The water delivery system of claim 10 including a pair of display screens associated respectively with the pair of indicator lights and disposed respectively between an indicator light and indicator button.

12. A combination of a combi-boiler apparatus and a system for providing hot and cold water in a domestic water delivery system; said combi-boiler providing heated water for heating an establishment; said domestic water delivery system including a water recirculation circulator that feeds the combi-boiler; and a control device connected to the circulator for controlling an operation thereof; said control device including means for controlling the respective "on" and "off" times of operation of the circulator fine-tuned to any home or business wherein the "on" and "off" time of the domestic hot water recirculation circulator is one of an analog version and a digital version; wherein the control device includes a display box for mounting components; wherein, for the analog version there is included on a flat surface of the display box a pair of adjacently disposed rotary dials; one of the rotary dials controlling the "on" time of the circulator and the other of the pair of rotary dials controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a timer for measuring time by turning a timer dial clockwise to the current time in a 24-hour period; wherein the "on" indicator light is arranged over the dial that controls "on" time; and wherein the "off" indicator light is arranged over the dial that controls "off" time; and wherein the display box has a top surface and a bottom surface, with an electrical connection provided at the top surface to a power outlet and with the bottom surface for mounting a connection to the circulator.

13. A combination of a combi-boiler apparatus and a system for providing hot and cold water in a domestic water delivery system; said combi-boiler providing heated water for heating an establishment; said domestic water delivery system including a water recirculation circulator that feeds the combi-boiler; and a control device connected to the circulator for controlling an operation thereof; said control device including means for controlling the respective "on" and "off" times of operation of the circulator fine-tuned to any home or business wherein the "on" and "off" time of the domestic hot water recirculation circulator is one of an analog version and a digital version; wherein the control device includes a display box for mounting components; wherein, for the digital version there is included on a flat surface of the display box a pair of adjacently disposed indicator buttons; one of the indicator buttons controlling the "on" time of the circulator and the other of the pair of indicator buttons controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a digital timer module for measuring time by turning a timer dial in a 24-hour period; wherein the "on" indicator light is arranged to the side of the indicator button that controls "on" time; and wherein the "off" indicator light is arranged to the side of the indicator button that controls "off" time; wherein the display box has a top surface and a bottom surface, with an electrical connection provided at the top surface to a power outlet and with the bottom surface for mounting a connection to the circulator; and including a pair of display screens associated respectively with the pair of indicator lights and disposed respectively between an indicator light and indicator button.

14. A water delivery system in which there is provided control between a boiler and a domestic hot water apparatus that includes a recirculation circulator, means for controlling the "on" and "off" time of the domestic hot water recirculation circulator by means of a guard member, an input cold water line that connects to the boiler, a home heating line that is connected from the boiler and for providing hot water for heating purposes, a hot water line from the boiler to the circulator, a hot water line from the circulator to provide domestic hot water for the home, the guard member for controlling the "on" and "off" time of the circulator, the guard member connected with an AC outlet for powering the guard member, a control line from the guard member to the circulator for controlling the circulator wherein the "on" and "off" time of the domestic hot water recirculation circulator is one of an analog version and a digital version; wherein the guard member includes a display box for mounting components; wherein, for the analog version there is included on a flat surface of the display box a pair of adjacently disposed rotary dials; one of the rotary dials controlling the "on" time of the circulator and the other of the pair of rotary dials controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a timer for measuring time by turning a timer dial clockwise to the current time in a 24-hour period; wherein the "on" indicator light is arranged over the dial that controls "on" time; and wherein the "off" indicator light is arranged over the dial that controls "off" time; and wherein the display box has a top surface and a bottom surface, with an electrical connection provided at the top surface to a power outlet and with the bottom surface for mounting a connection to the circulator.

15. A water delivery system in which there is provided control between a boiler and a domestic hot water apparatus that includes a recirculation circulator, means for controlling the "on" and "off" time of the domestic hot water recirculation circulator by means of a guard member, an input cold water line that connects to the boiler, a home heating line that is connected from the boiler and for providing hot water for heating purposes, a hot water line from the boiler to the circulator, a hot water line from the circulator to provide domestic hot water for the home, the guard member for controlling the "on" and "off" time of the circulator, the guard member connected with an AC outlet for powering the guard member, a control line from the guard member to the circulator for controlling the circulator wherein the "on" and "off" time of the domestic hot water recirculation circulator is one of an analog version and a digital version; wherein the guard member includes a display box for mounting components; wherein, for the digital version there is included on a flat surface of the display box a pair of adjacently disposed indicator buttons; one of the indicator buttons controlling the "on" time of the circulator and the other of the pair of indicator buttons controlling the "off" time of the circulator; including on the flat surface of the display box a pair of adjacently disposed indicator lights; one of the indicator lights indicating the "on" time of the circulator and the other of the pair of indicator lights indicating the "off" time of the circulator; including on the flat surface of the display box a digital timer module for measuring time by turning a timer dial in a 24-hour period; wherein the "on" indicator light is arranged to the side of the indicator button that controls "on" time; and wherein the "off" indicator light is arranged to the side of the indicator button that controls "off" time; wherein the display box has a top surface and a bottom surface, with an electrical connection provided at the top surface to a power outlet and with the bottom surface for mounting a connection to the circulator; and including a pair of display screens associated respectively with the pair of indicator lights and disposed respectively between an indicator light and indicator button.

* * * * *